US010287531B2

(12) United States Patent
Trailokya et al.

(10) Patent No.: US 10,287,531 B2
(45) Date of Patent: May 14, 2019

(54) FREE-FLOWING, SOLID, HIGH ACTIVE ALKYL ETHER SULFATES

(71) Applicant: GALAXY SURFACTANTS LTD., Navi Mumbai (IN)

(72) Inventors: Sagar Anil Trailokya, Navi Mumbai (IN); Shantaram Jagannath Kadam, Navi Mumbai (IN); Dhananjay Chandrakant Tambe, Dombivali (E) (IN); Nithyanandan Chenniappan, Navi Mumbai (IN); Sesha Samba Murty Garikiparthy, Navi Mumbai (IN)

(73) Assignee: GALAXY SURFACTANTS LTD., Maharashtra (IN)

( * ) Notice: Subject to any disclaimer, the term of this patent is extended or adjusted under 35 U.S.C. 154(b) by 260 days.

(21) Appl. No.: 14/905,423

(22) PCT Filed: May 19, 2014

(86) PCT No.: PCT/IN2014/000334
§ 371 (c)(1),
(2) Date: Jan. 15, 2016

(87) PCT Pub. No.: WO2015/008296
PCT Pub. Date: Jan. 22, 2015

(65) Prior Publication Data

US 2016/0168512 A1 Jun. 16, 2016

(30) Foreign Application Priority Data

Jul. 18, 2013 (IN) ..... 2404/MUM/2013

(51) Int. Cl.

| | |
|---|---|
| ***C11D 1/00*** | (2006.01) |
| ***C11D 1/29*** | (2006.01) |
| ***C11D 3/08*** | (2006.01) |
| ***C11D 3/10*** | (2006.01) |
| ***C11D 3/12*** | (2006.01) |
| ***C11D 3/22*** | (2006.01) |
| ***C11D 17/00*** | (2006.01) |

(52) U.S. Cl.
CPC ..... *C11D 1/29* (2013.01); *C11D 3/08* (2013.01); *C11D 3/10* (2013.01); *C11D 3/128* (2013.01); *C11D 3/22* (2013.01); *C11D 17/0039* (2013.01)

(58) Field of Classification Search
None
See application file for complete search history.

(56) References Cited

U.S. PATENT DOCUMENTS

| | | | |
|---|---|---|---|
| 5,807,817 | A | 9/1998 | Mazzola |
| 5,916,868 | A | 6/1999 | Mazzola |

(Continued)

FOREIGN PATENT DOCUMENTS

| | | |
|---|---|---|
| EP | 0 105 160 | 4/1984 |
| EP | 0 430 603 A2 | 6/1991 |
| EP | 0 651 050 A1 | 5/1995 |

(Continued)

*Primary Examiner* — Necholus Ogden, Jr.
(74) *Attorney, Agent, or Firm* — Kramer Amado, P.C.

(57) ABSTRACT

The present invention relates to free flowing, solid, high active alkyl ether sulfates and process for manufacturing such solid alkyl ether sulfates at processing temperature of 80° C. and above on an industrial scale. The solid alkyl ether sulfates have improved flow properties, improved appearance, and improved solubility.

19 Claims, 3 Drawing Sheets

(56) References Cited

U.S. PATENT DOCUMENTS

Figure 1:
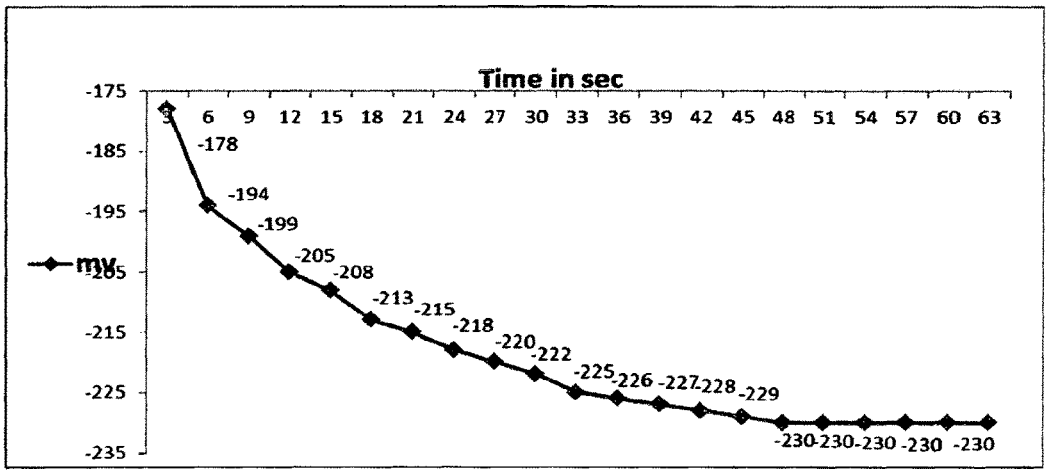

| | | | |
|---|---|---|---|
| 6,221,831 | B1 | 4/2001 | Emery |
| 6,369,020 | B1 | 4/2002 | Kohlus et al. |

FOREIGN PATENT DOCUMENTS

| | | |
|---|---|---|
| IN | 214078 | 7/2005 |
| IN | 1 2623MUM2009 | 10/2010 |
| WO | WO 97/10321 | 3/1997 |
| WO | WO 97/32002 | 9/1997 |
| WO | WO 98/54278 | 12/1998 |
| WO | WO 98/54289 | 12/1998 |
| WO | WO 00/31223 | 6/2000 |
| WO | WO 00/31233 | 6/2000 |
| WO | WO 01/81528 A1 | 11/2001 |

FREE-FLOWING, SOLID, HIGH ACTIVE ALKYL ETHER SULFATES

FIELD OF INVENTION

The present invention relates to free-flowing, solid, high active alkyl ether sulfates. It particularly relates to free-flowing, solid alkyl ether sulfates having active content of at least 50% by weight. It also relates to the process of manufacturing the free-flowing, solid, high active alkyl ether sulfates. In particular, it relates to the process of manufacturing the free-flowing, solid, high active alkyl ether sulfates at drying temperature of 80° C. and above. The said alkyl ether sulfates are preferably used in laundry detergents and dish washing detergents.

BACKGROUND OF INVENTION

There has been considerable interest within the detergent industry for solid laundry and dish washing detergents which are "compact" and therefore, low dosage volumes are in demand for effective laundering and dish washing operations. To facilitate production of these so-called low dosage detergents, following three important conditions have to be fulfilled.

1. Detergent particles containing high concentration of detergent or surfactant active(s);
2. Detergent particles of high bulk density, for example with a density of 600 g/l or higher; and
3. Non-sticky and free-flowing detergent particles.

Generally, there are three primary types of processes by which solid detergents either granules or powders can be prepared. The first type of process involves spray-drying an aqueous detergent slurry in a spray-drying tower to produce highly porous detergent granules (e.g., tower process for low density detergent compositions). The second type of process involves spray-drying an aqueous detergent slurry in a spray-drying tower as the first step, then, the resultant granules are agglomerated with a binder such as a nonionic or anionic surfactant, finally, various detergent components are dry mixed to, produce detergent granules (e.g., tower process plus non-tower [agglomeration] process for high density detergent compositions). In the third type of process, the various detergent components are dry mixed after which they are agglomerated with a binder such as a nonionic or anionic surfactant, to produce high density detergent compositions (e.g., non-tower [agglomeration] process for high density detergent compositions).

Due to excellent detergent properties and high biodegradability, alkyl ether sulfates are the preferred and most widely used surfactant actives in compact laundry detergent compositions. Alkyl ether sulfates are known to be used in detergent compositions in aqueous solution or paste form. However as it is necessary to control the ratio of liquids to solids in order to form detergent granules, the maximum level of surfactant active material which may be incorporated in this manner is limited. Also, alkyl ether sulfates are highly heat sensitive and therefore cannot be processed at elevated temperatures because of a tendency to decompose significantly at temperatures higher than 80° C. Therefore, they are not generally incorporated into spray-dried laundry powders via the slurry.

It is therefore desirable to incorporate these alkyl ether sulfates as a separate solid component to manufacture the compact laundry detergent compositions. Agglomeration is one such method wherein surfactant active material is dry mixed with other detergent components to prepare the solid detergent compositions. However, it has been still not possible to produce solid detergent compositions comprising high concentration of surfactant actives such as alkyl ether sulfates.

High levels of surfactant actives are required in laundry detergent compositions, particularly in compositions intended for washing by hand, to give effective soil removal. However, it has been found that problems of poor powder properties can be encountered in high-active compositions, for example, powder stickiness leading to agglomeration and poor flow. Hence, many prior arts mention about producing low active of less than 40% of surfactant active ingredients.

U.S. Pat. No. 6,221,831 (Unilever) describes use of low amount of about 7% maximum of detergency builders such as zeolites and the active anionic surfactant claimed is at least 27%.

Indian patent application no. 2623/MUM/2009 (Hindustan Unilever Ltd.) describes a free-flowing detergent granules comprising 10-30% of anionic surfactants.

U.S. Pat. No. 5,916,868 (Church & Dwight Co.) relates to a process for the production of a free-flowing high bulk density granular laundry detergent product comprising up to 40% of surfactant.

EP 105 160A (Akzo) discloses silicas loaded with aqueous surfactant solutions, preferably primary alcohol sulfate, alkyl ether sulfate or nonionic surfactant, for use in toothpastes; the highest surfactant loading disclosed in a free-flowing granule is 20 wt %, higher loadings being detrimental to flow.

Another requirement for preparing compact detergent is to have high bulk density.

There are prior arts which teach the preparation of both high bulk density and low bulk density detergents. IN 214078 (P&G) describes the process of producing a low density detergent composition which is having a density of less than 600 g/l.

Detergent compositions having a high bulk density are typically prepared by a process involving mixing or granulation of components of the composition and/or a base powder obtained for example from a spray-drying process and provide significant consumer benefits as compared to compositions of lower bulk density.

It is also known to incorporate anionic surfactant e.g. fatty alkyl ether sulfates in detergent compositions by means of a solid adjunct, that is, a particle comprising the surfactant and other components of the composition e.g. sodium carbonate and a builder. Hitherto, the level of anionic surfactant present in such adjuncts has been limited due to the need to provide good flow properties and to reduce the tendency to agglomerate.

There have been many attempts on achieving solid particles having high loading of alkyl ether sulfates and that too maintaining the free-flowing nature of the particles.

EP 430 603A (Unilever) discloses detergent granules containing at least 30 wt % anionic surfactant and a highly oil-absorbent filler, for example, a silica, in intimate contact with the anionic surfactant.

EP 651 050A (Procter & Gamble) discloses detergent agglomerates comprising a solid, preferably water-soluble, a salt (for example, sodium silicate, carbonate or sulfate), and a fluid binder comprising an anionic surfactant (preferably alkyl ether sulfate) and sodium silicate.

U.S. Pat. No. 6,369,020 (Unilever) teaches to prepare free-flowing granular detergent component comprising at least 30%, preferably 30-75% of alkyl ether sulfates.

WO 97 10321A (Procter & Gamble) discloses structured surfactant compositions comprising 35-60 wt % surfactant, preferably alkyl ether sulfate, 1-20 wt % hydrophilic finely-divided silica and 15-25 wt % moisture; these compositions are in the form of a "hardened continuous paste".

Thus, although there have been many attempts to prepare solid, high active alkyl ether sulfate compositions but still there is a need to have even more high active i.e. at least 50% active content, preferably more than 60% and more preferably more than 70% and even more preferably more than 75% which was not possible in the prior art processes/compositions. Also, all the prior arts teach about heating alkyl ether sulfates at temperature lower than 80° C. to avoid its decomposition.

In accordance with the above, the inventors of the present invention have surprisingly found a unique process to produce free-flowing, solid, highly concentrated alkyl ether sulfates by processing it at temperature of above 80° C. through unique combination of zeolites, carbonates, structurant and coating material. These solid, high active alkyl ether sulfates then can be used in combination with other detergent adjuvants to prepare the final detergent formulations or can be directly used as final detergent formulations.

SUMMARY OF INVENTION

In line with the above objective, the present invention provides a process for manufacturing free-flowing, solid, high active alkyl ether sulfates by processing at temperature of 80° C. and above.

Accordingly, the present invention is directed to a process which produces free flowing, solid, high active alkyl ether sulfates involving the following steps:

(i) feeding alkyl ether sulfate, amorphous zeolite, carbonate and structurant into the mixer to form a mixture;

(ii) heating the mixture at 80-120° C. followed by addition of crystalline zeolite to the mixture;

(iii) cooling the mixture up to 70° C. to obtain solid form of the mixture; and (iv) coating the solid form with coating material.

Thus the present invention provides an efficient and economical process to facilitate large-scale production of free-flowing, solid, high active alkyl ether sulfates.

According to another aspect, the present invention provides free-flowing, solid, high active alkyl ether sulfates.

In another aspect, the present invention provides free-flowing, solid alkyl ether sulfates with concentration of at least 50% by weight.

In another aspect, the present invention provides free-flowing, solid alkyl ether sulfates with concentration of at least 60% by weight.

In a further aspect, the present invention provides free-flowing, solid alkyl ether sulfates with concentration of at least 70% by weight.

In yet another aspect, the present invention provides free-flowing, solid, high active alkyl ether sulfates with coating.

Accordingly, the present invention provides free flowing, solid, high active alkyl ether sulfates which comprises:

a. 50% to 90% by weight of alkyl ether sulfate;

b. 0.5% to 5% by weight of carbonate;

c. 5% to 50% by weight of zeolites;

d. 0.5% to 3% by weight of structurant; and e. 1% to 10% by weight of coating material.

Another aspect of the present invention provides free-flowing, solid, high active alkyl ether sulfates having very low moisture content of less than 5% by wt.

In yet another aspect, the present invention provides free-flowing, solid, high active alkyl ether sulfates having needle and granule shapes.

In yet another aspect, the present invention provides free-flowing, solid, high active alkyl ether sulfates with long storage and excellent transport efficiency without losing free flowability and with improved whiteness.

According to further aspect, the present invention provides colored, free-flowing, solid, high active alkyl ether sulfates.

In yet another aspect, the present invention provides use of free flowing, solid, high active alkyl ether sulfates in laundry detergent compositions and dish-washing compositions. The details of one or more embodiments of the inventions are set forth in the description below. Other features, objects and advantages of the inventions will be apparent from the appended examples and claims.

BRIEF DESCRIPTION OF THE ACCOMPANYING DRAWINGS

FIG. 1: Graph of Dissolution time of 56% active Sodium lauryl ether sulfate (SLES) needles in 1% aqueous solution.

Figure 2:
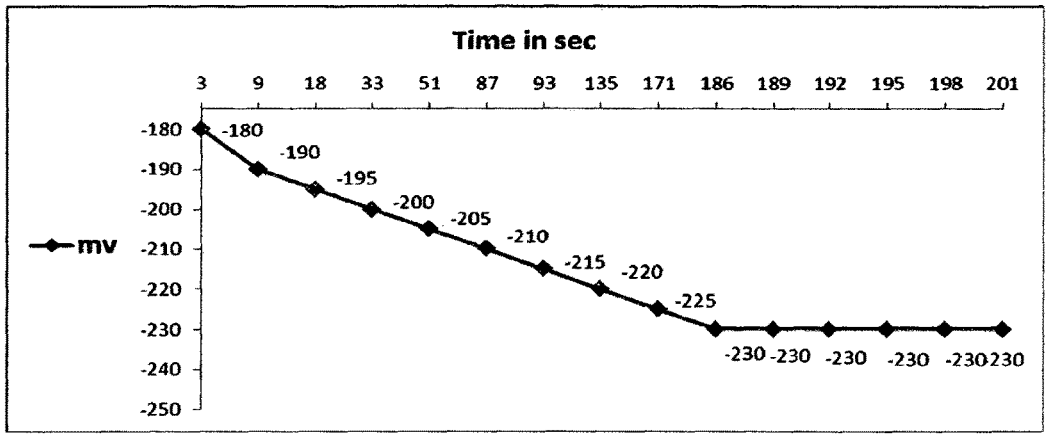

FIG. 2: Graph of Dissolution time of 70% active Sodium lauryl ether sulfate (SLES) paste in 1% aqueous solution.

Figure 3:
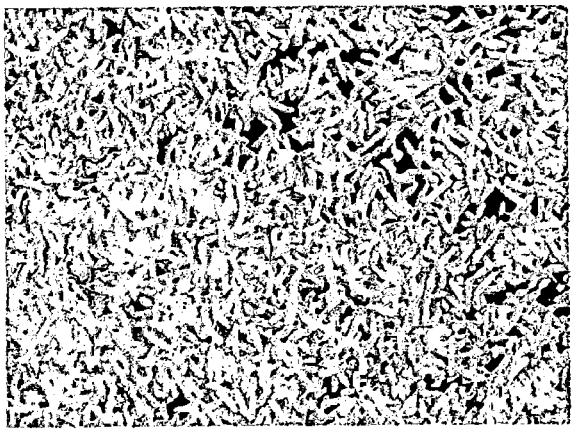

FIG. 3: 67% active Sodium lauryl ether sulfate (SLES) needles.

Figure 4:
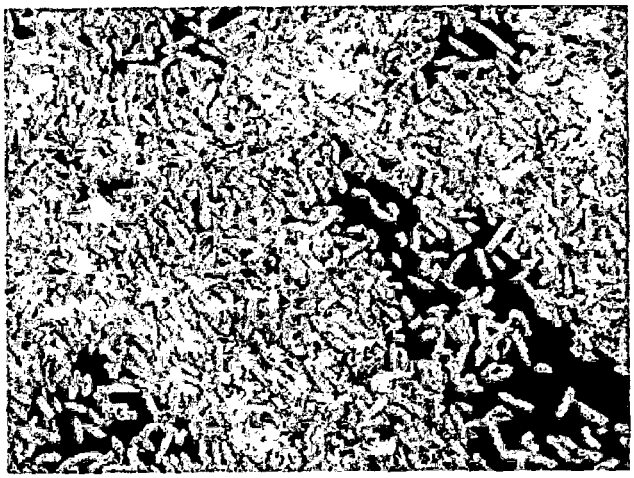

FIG. 4: 83% active Sodium lauryl ether sulfate (SLES) needles.

Figure 5:
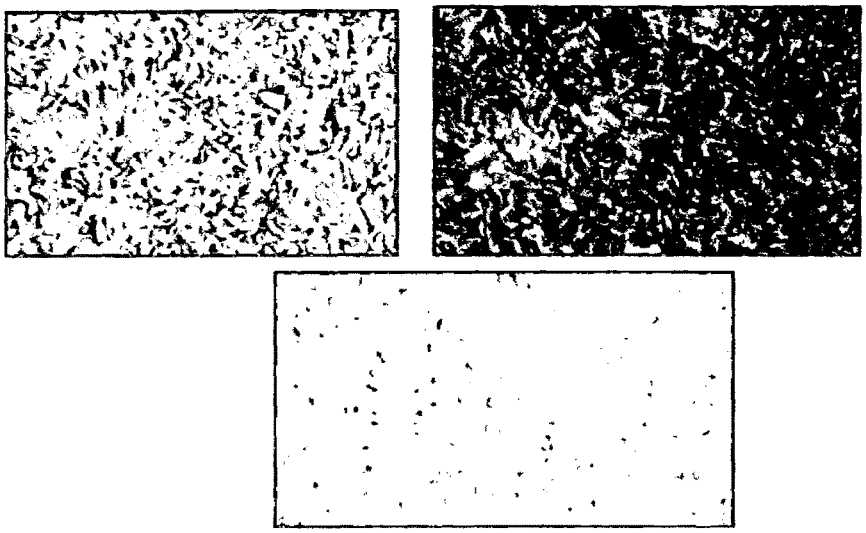

FIG. 5: Pink, Blue & yellow colored 56% active Sodium lauryl ether sulfate (SLES) needles.

DETAILED DESCRIPTION OF INVENTION

The important step in preparing solid alkyl ether sulfates is drying. Solid alkyl ether sulfates are prepared by mixing liquid alkyl ether sulfates with other ingredients and drying the mixture. As explained in the prior art, alkyl ether sulfates being heat sensitive have never been able to process at more than 80° C. and hence it takes many hours to prepare solid, high active alkyl ether sulfates through drying. Surprisingly, inventors of the present invention have found out a process for preparing solid, high active alkyl ether sulfates which can be carried out by drying at temperatures higher than 80° C. without degradation of alkyl ether sulfates.

The inventors of the present invention have found that the unique combination of zeolites and carbonates gives excellent buffering towards $H^+$ ions and helps to achieve the high active alkyl ether sulfates with reduced batch cycle time. Alkyl ether sulfates are highly heat sensitive and can be hydrolyzed in presence of heat (temperature more than 80° C.) and moisture. Hydrolysis product gives sulfuric acid and ethoxylated alkyl alcohol and acidic pH of the material catalyses hydrolysis further. Addition of zeolite and carbonate, in combination, during drying stage, arrests hydrolysis of alkyl ether sulfates remarkably and hence alkyl ether sulfates withstand high drying temperature for prolonged hours. It is observed that carbonate or zeolite, alone, does not work but when they are used in combination, the alkyl ether sulfates can be heated up to 120° C. without any hydrolysis or significant decrease in surfactant activity. This particular phenomenon of zeolite and carbonate gives added advantage during drying of alkyl ether sulfates. It increases the process efficiency in terms of reduced processing time to prepare the high active product. Another important aspect found out by the inventors of the present invention is that the solid, high active alkyl ether sulfates prepared are non-sticky and free-flowing. The unique combination of amorphous and crystalline zeolites and the final coating of the product with a coating material imparts the free-flowing property to the product which is not taught in the prior art.

The various solid forms of alkyl ether sulfates that can be prepared as per present invention are agglomerates, powder, extrudates, flakes, beads, noodles and preferably needles and granules.

Thus, the present invention is directed to a process for preparing free flowing, solid, high active alkyl ether sulfates involving the following steps:

(i) feeding alkyl ether sulfate into the mixer;
(ii) adding amorphous zeolite, carbonate and structurant to step (i) to form a mixture;
(iii) heating the mixture at 80-120° C.;
(iv) adding the crystalline zeolite to the mixture;
(v) cooling the mass up to 70° C.;
(vi) forming solid form of the mixture; and
(vii) coating the solid form with coating material.

The present invention further provides a free flowing, solid, high active, alkyl ether sulfates comprising a. from 50% to 90% by weight of alkyl ether sulfate;
b. from 0.5% to 5% by weight of carbonate;
c. from 5% to 50% by weight of zeolites;
d. from 0.5% to 3% by weight of structurant;
e. from 1% to 10% by weight of coating material.

According to an embodiment of the present invention, the moisture content of free-flowing, solid, high active alkyl ether sulfates of the present invention is preferably between 0 to 10 wt %, more preferably between 0 to 5 wt %, from the viewpoint of caking resistance. Lesser the moisture content, lesser is the caking and higher is the free-flowability.

According to an embodiment of the present invention, the pH maintained during the process is between 9-14.

The details of all the ingredients used to prepare free-flowing, solid, high active, alkyl ether sulfates are given below:

Alkyl Ether Sulfates

Alkyl ether sulfates are generally defined as salts of sulfated adducts of ethylene oxide with alkyl alcohols containing from about 8 to about 22 carbon atoms, which preferably correspond to formula:

$$RO—(CH_2CH_2O)_nSO_3X$$

in which R is a linear or branched hydrocarbon radical containing 8 to 22 carbon atoms, and n is an average number of ethylene oxide (EO) moles between 0.5 to 3.

X is an alkali metal, alkaline earth metal, ammonium or substituted ammonium.

The alkyl ether sulfates of the present invention have a alkyl chain containing 8 to 22 carbon atoms, preferably, the fatty alkyl chain contains 8 to 18 carbon atoms, preferably 12 to 18 carbon atoms, more preferably 12 to 16 carbon atoms, and still more preferably 12 to 14 carbon atoms. Typical examples of alkyl chain include, caprylyl, capryl, lauryl, myristyl, cetyl, palmityl, stearyl, behenyl, and the technical mixtures thereof obtained. Preferred examples are lauryl, coco, and mixture of lauryl and myristyl alkyl chain. The average degree of ethoxylation present in the alkyl ether sulfates of the present invention is from about 0.5 to 10 moles of ethylene oxide, preferably about 0.5 to 3 moles of ethylene oxide. A particularly preferred alkyl ether sulfate for use in the present invention is $C_{12-14}$ alkyl ether sulfate having average 1 mole of ethylene oxide, commercially available under the trade name "Galaxy LES 170" and another one is $C_{12-14}$ alkyl ether sulfate having average 2 moles of ethylene oxide, commercially available under the trade name "Galaxy LES 70" and still another one is $C_{12-14}$ alkyl ether sulfate having average 0.5 moles of ethylene oxide."

These alkyl ether sulfates are commonly available as 28% aqueous solution and 70% aqueous paste. Other concentrations can always be prepared with the known art, and used for the present invention. These alkyl ether sulfates also contain unsulfated ethoxylated fatty alcohols as an impurity in an amount of up to 3 wt % and inorganic salts such as sodium chloride and sulfates up to 2% by weight.

Zeolites

Zeolites are known for assisting or enhancing cleaning performance and controlling mineral hardness. Zeolites are of great importance in most currently marketed heavy duty granular detergent compositions, and can also be a significant builder ingredient in solid detergent formulations.

The zeolites may be crystalline or amorphous in structure and can be naturally occurring aluminosilicates or synthetically derived. Crystalline zeolites can be commercially available such as zeolite A (zeolite 4A), maximum aluminium zeolite P (zeolite MAP), zeolite B, zeolite X, zeolite Y. Alternatively, naturally-occurring or synthetically derived aluminosilicate ion exchange materials suitable for use herein can be made as described by Krumrnel et al, in U.S. Pat. No. 3,985,669. In the present invention amorphous zeolite used is "DET BUILD-150" supplied by Gujarat Multi Gas Base Chemicals Pvt. Ltd. It contains minimum 15.6% $Na_2O$, 32.3% $SiO_2$, 29.0% $Al_2O_3$. It has water adsorption capacity of about 24%. The crystalline zeolite used in the present invention is "sodium alumino silicate zeolite 4A" supplied by Zeolites And Allied Products Pvt. Ltd. It contains minimum 18.0% $Na_2O$, 38.0% $SiO_2$, 34.0% $Al_2O_3$. It has water adsorption capacity of about 24%.

The inventors of the present invention have found that the amorphous and crystalline zeolites play an important role for getting the desired solid form, particularly the ratio of amorphous to crystalline zeolites. In the case of needle form, use of only amorphous zeolite leads to sticky needles whereas use of only crystalline zeolite leads to undue hardness thereby posing problem in needling. For the needle shaped free-flowing alkyl ether sulfates, the ratio of amorphous zeolite to crystalline zeolite should be from 80:20 to 20:80.

Another aspect of the present invention is the sequence of addition of both types of zeolites. Amorphous zeolite is added in the first step of the heating whereas addition of crystalline zeolite is done just before last step of coating of solid alkyl ether sulfates. If crystalline zeolite is added at the initial stage, it results in stickiness of the finally formed product.

In an embodiment, the free-flowing, solid, high active alkyl ether sulfates comprise 5-50 wt % zeolites, preferably 5-40 wt % zeolites.

Carbonates

Laundry detergent compositions comprising a water-soluble alkaline carbonates are well-known in the art. For example, it is conventional to use such carbonates as builders in detergent compositions which supplement and enhance the cleaning effect of the active surfactants present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics.

Apart from novel buffering activity of the carbonates in combination with zeolites, further advantage of using them in the present invention is that it reduces the froth which is formed during the process. Also, it imparts more whiteness and therefore leads to color improvement of the final product.

Examples of carbonates suitable for the present invention include alkaline earth metal carbonates such as magnesium carbonate, calcium carbonate and alkali metal carbonates such as sodium carbonate, potassium carbonate, preferably sodium carbonate.

In addition, the present invention may include the bicarbonates of the alkaline earth metals and alkali metals.

The product of the present invention contains sodium carbonate in order to increase detergency and easy processing. Sodium carbonate may suitably be present in amounts ranging from 0.5 to 5 wt %, preferably from 0.5 to 2 wt %.

In an embodiment, the ratio of carbonate to Zeolite is 1:10 to 1:50.

Structurants:

Suitable structurant may include materials selected from soaps, sugars, water-soluble polymers, alkali metal silicates and combinations thereof. Preferred examples include glucose, maltose, sucrose, ethylene glycol, homo- and copolymers, polyvinyl alcohols polyacrylates, and acrylic/maleic copolymers (eg Sokalan (Trade Mark) CP5 ex BASF). The term "sugar" as used herein is a generic term for a class of carbohydrates which are usually crystalline and sweet by nature, and which are water soluble. Sugars are formed from glucose and fructose units which are sugars in their own right. Preferred sugars include glucose, fructose, galactose, sucrose, maltose, lactose, sorbitol, manitol, rafinose, and trehalose.

Amongst the sugars which are useful in this invention is sucrose, which is most preferred for reasons of availability and cheapness; glucose; fructose; maltose (malt sugar); cellulose and lactose which are disaccharides.

In an embodiment, 0.5-3 wt % sugar is used, preferably 2 wt %.

Color Pigments

The solid alkyl ether sulfates of the present invention can be colored with various color pigments without affecting its physical performance. These solid alkyl ether sulfates are mixed with color in mixer or blender and then extruded or converted into desired form.

Color Pigments may be selected from inorganic and organic pigments; preferably the pigments are organic pigments.

The pigment may be of any color; preferably the pigment is blue, red, pink or yellow in color.

Preferred pigments are CC Blue Fine Paste 615 (Clariant Chemicals), Liquitint Red SP (Milliken Chemicals), Liquitint Yellow LP (Milliken Chemicals).

Blue pigment is in paste form and need to be diluted with water before coloring and red and yellow are in liquid form and are used as it is. Pigments are preferably present from 0.1 to 0.8 wt %.

The colored solid alkyl ether sulfates prepared as per the present invention are illustrated in FIG. 5.

Coating

The solid alkyl ether sulfates of the present invention are coated with a coating material. The coating material is silicates, preferably silica. Coating is applied as a final step by using dry powder of the coating material. Due to this coating, the solid alkyl ether sulfates becomes non-sticky and free-flowable. The particle coating layer imparts new surface and appearance properties on solid alkyl ether sulfates. Further, the coated solid alkyl ether sulfates provide improved flowability profile to the final detergent products also without any clumping.

For the purpose of present invention coating is done by "MFIL-100 precipitated silica" supplied by Madhu Silica Pvt. Ltd. It has minimum 98.5% $SiO_2$ content.

Titanium dioxide can be added optionally for improving the whiteness of the solid alkyl ether sulfates. About 0.01-1 wt. % of titanium dioxide can be added.

The solid Alkyl ether sulfates of the desired form can be prepared by known conventional methods such as (i) Extrusion, cutting and coating to give needles.

(ii) Extrusion, milling and coating to give small needles and non-uniform granules.

(iii) Extrusion, spheroidization and coating to give granules.

(iv) Flaking, milling and coating to give non-uniform granules.

The free-flowing, solid, high active alkyl ether sulfates prepared by the processes claimed herein may be used directly as final detergent compositions or they may be mixed with other detergent ingredients or additives to make final detergent compositions for laundering fabrics and the dish-washing purposes.

Further, the solid alkyl ethers sulfates of the present invention are so excellent in free-flowability that it retains its flowability even if we stack and store it for longer time or longer days. This property will help in transportation as it will make the transport of the material without having formation of clumps or agglomerates during transportation.

EXAMPLES

The present invention is described by way of working on limiting illustrative examples. The detail of the invention provided in the following examples is given by the way of illustration only and should not be construed to limit the scope of the present invention.

Example 1

Preparation of 56% Active SLES Needles

8 Kg (70% Active matter) Sodium lauryl ether sulfate (SLES 70 1EO) was charged in a mixer. To this were added 2.46 Kg of amorphous zeolite, 0.2 Kg sodium carbonate and 0.1 Kg sugar. The contents were mixed to ensure homogenous mass and heated up to 80° C. to 90° C. under vacuum. The pH was monitored periodically and confirmed that it was between 10-11. After every one hour, the active mass was checked and on obtaining the desired active mass, 1.14 Kg of crystalline zeolite was added. The homogenous mass was cooled to 70° C. and fed into a needler. The needles formed were coated with 0.2 Kg silica in the mixer.

Composition of 56% active SLES needles

| Ingredients | % |
|---|---|
| SLES 70 1EO | 56 |
| Amorphous zeolite | 24.6 |
| Sodium carbonate | 2.0 |
| Sugar | 1.0 |
| Crystalline zeolite | 11.4 |

-continued

| Composition of 56% active SLES needles | |
|---|---|
| Ingredients | % |
| Silica | 2.0 |
| Water | 3.0 |
| Total | 100.0 |

Example 2

Preparation of 67% Active SLES Needles 9.54 Kg (70% Active matter) Sodium lauryl ether sulfate (SLES 70 1 EO) was charged in a mixer. To this were added 1.33 Kg of amorphous zeolite, 0.05 Kg sodium carbonate and 0.2 Kg sugar. The contents were mixed to ensure homogenous mass and heated up to 80° C. to 90° C. under vacuum. The pH was monitored periodically and confirmed that it was between 10-11. After every one hour, the active mass was checked and on obtaining the desired active mass, 1.24 Kg of crystalline zeolite was added. The homogenous mass was cooled to 70° C. and fed into a needler. The needles formed were coated with 0.2 Kg silica in the mixer.

67% active solid Alkyl ether sulfates is illustrated in FIG. 3.

| Composition of 67% active SLES needles | |
|---|---|
| Ingredients | % |
| SLES 70 1EO | 66.8 |
| Amorphous zeolite | 13.3 |
| Sodium carbonate | 0.5 |
| Crystalline zeolite | 12.4 |
| Sugar | 2.0 |
| Silica | 2.0 |
| Water | 3 |
| Total | 100.0 |

Example 3

Preparation of 83% Active SLES Needles 11.8 Kg (70% Active matter) Sodium lauryl ether sulfate (SLES 70 1EO) was charged in a mixer. To this was added 0.46 Kg of amorphous zeolite, 0.05 Kg sodium carbonate, 0.05 Kg Titanium dioxide and 0.18 Kg sugar. The contents were mixed to ensure homogenous mass and heated up to 80° C. to 90° C. under vacuum. The pH was monitored periodically and confirmed that it was was between 10-11. After every 1 hour, the active mass was checked and on obtaining the desired active mass, 0.49 Kg of crystalline zeolite was added. This mass was mixed till it became homogenous. This homogenous mass was cooled to 70° C. and fed into a needler. The needles formed were then coated with 0.18 Kg silica in the mixer.

83% active solid Alkyl ether sulfate needles are illustrated in FIG. 4.

| Composition of 83% active SLES needles | |
|---|---|
| Ingredients | % |
| SLES 70 1EO | 82.8 |
| Amorphous zeolite | 4.6 |
| Titanium dioxide | 0.45 |
| Sodium carbonate | 0.5 |
| Crystalline zeolite | 4.93 |
| Sugar | 1.8 |
| Silica | 1.82 |
| Water | 3.1 |
| Total | 100.0 |

Example 4

Preparation of 83% Active SLES Granules 11.83 Kg (70% Active matter) Sodium lauryl ether sulfate (SLES 70 1EO) was charged in a mixer. To this was added 0.46 Kg of amorphous zeolite, 0.05 Kg sodium carbonate, 0.05 Kg Titanium dioxide and 0.18 Kg sugar. The contents were mixed to ensure homogenous mass and heated up to 80° C. to 90° C. under vacuum. The pH was monitored periodically and confirmed that it was between 10-11. After every 1 hour, the active mass was checked and on obtaining desired active mass, 0.49 Kg of crystalline zeolite was added. This mass was mixed till it becomes homogenous. This homogenous mass was cooled to 70° C. and fed to triple roll mill to form the flakes. These flakes were then granulated and coated with 0.182 Kg silica in the mixer.

| Composition of 83% active SLES granules | |
|---|---|
| Ingredients | % |
| SLES 70 1EO | 82.8 |
| Amorphous zeolite | 4.6 |
| Titanium dioxide | 0.45 |
| Sodium carbonate | 0.5 |
| Crystalline zeolite | 4.93 |
| Sugar | 1.8 |
| Silica | 1.82 |
| Water | 3.1 |
| Total | 100.0 |

Example 5

Preparation of 56% Active SLES Needles at High Temperature

8 Kg (70% Active matter) Sodium lauryl ether sulfate (SLES 70 1 EO) was charged in a mixer. To this were added 2.46 Kg of amorphous zeolite, 0.2 Kg sodium carbonate and 0.1 Kg sugar. The contents were mixed to ensure homogenous mass and heated up to 110° C. to 115° C. under vacuum. The pH was monitored periodically and confirmed that it was between 10-11. After every one hour, the active mass was checked and on obtaining the desired active mass, 1.14 Kg of crystalline zeolite was added. The homogenous mass was cooled to 70° C. and fed into a needler. The needles were packed in air tight container. The needles were coated with 0.2 Kg silica in the mixer.

| Composition of 56% active SLES needles | |
|---|---|
| Ingredients | % age |
| SLES 70 1EO | 56 |
| Amorphous zeolite | 24.6 |
| Sodium carbonate | 2 |
| Sugar | 1 |
| Crystalline zeolite | 11.4 |
| Silica | 2 |
| Water | 3 |
| Total | 100 |

COMPARATIVE EXAMPLES

Example 6

Preparation of 83% Active SLES Needles without Amorphous Zeolite & Sodium Carbonate Both Example 3 was repeated but without adding amorphous zeolite and Sodium carbonate. It was observed that SLES was getting hydrolyzed substantially and the active content decreased in the range of 8-10% within 4 hours of heating at reaction temperature of 90-100° C.

Example 7

Preparation of 83% Active SLES Needles without Amorphous Zeolite

Example 3 was repeated without adding amorphous zeolite. It was observed that SLES was getting hydrolyzed and the active content decreased by 8-9% in 4 hours of heating at reaction temperature of 90-100° C.

Example 8

Preparation of 83% Active SLES Needles without Sodium Carbonate

Example 3 was repeated without addition of sodium carbonate. It was observed that the active content decreased by 6-8% within 4 hours of heating at 90-100° C. It was found that after 100° C., material starts hydrolyzing fast and when the temperature reached 106° C., entire SLES got hydrolyzed.

Performance Test of Solid Alkyl Ether Sulfate Prepared as Per Present Invention:

Dissolution Time of Needles Versus Paste Form of Sodium Lauryl Ether Sulfate:

Dissolution test was conducted by dissolving 1 gm of sample in 100 ml distilled water and change in millivolts was recorded. At constant millivolts, it was concluded that dissolution is complete.

Dissolution time of 56% active Sodium lauryl ether sulfate (SLES) needles in 1% aqueous solution is illustrated in FIG. 1 whereas dissolution time of paste of 70% active Sodium lauryl ether sulfate (SLES) in 1% aqueous solution is illustrated in FIG. 2.

It was observed that solid, Alkyl ether sulfates prepared as per the present invention exhibit better dissolution properties in water than the paste of Alkyl ether sulfates. This dissolution property is the most desirable property required for any detergent formulation to work efficiently and effectively.

We claim:

1. The process for preparing free-flowing, solid, high active alkyl ether sulfates comprising the steps of (i) feeding alkyl ether sulfate, amorphous zeolite, carbonate and structurant into a mixer to form a mixture;

(ii) heating the mixture at 80-120° C. followed by the addition of crystalline zeolite to the mixture;

(iii) cooling the mixture to a temperature of up to 70° C. to obtain a solid form of the mixture and (iv) coating the solid form with a coating material.

2. The process for preparing free-flowing, solid, high active alkyl ether sulfates according to claim 1, wherein the solid form is needle or granule.

3. The process for preparing free-flowing, needle shaped, high active alkyl ether sulfates, comprising the steps of (i) feeding a paste of 70% active alkyl ether sulfate, amorphous zeolite, carbonate and structurant into a mixer to form a mixture;

(ii) heating the mixture at 80-120° C. followed by the addition of crystalline zeolite to the mixture;

(iii) cooling the mixture to a temperature of up to 70° C.;

(iv) extruding the cooled mixture through a needler to form needles of alkyl ether sulfates; and (v) coating the needles of alkyl ether sulfates with a coating material.

4. The process for preparing free-flowing, solid, high active alkyl ether sulfates according to claim 3, wherein, the amorphous and crystalline zeolites are in the ratio of 80:20 to 20:80.

5. The process for preparing free-flowing, solid, high active alkyl ether sulfates according to claim 3, wherein the carbonate and zeolite are in the ratio of 1:10 to 1:50.

6. The process for preparing free-flowing, solid, high active alkyl ether sulfates according to claim 3, wherein, the carbonate is an alkaline earth metal carbonate or an alkali metal carbonate or their bicarbonates or mixtures thereof.

7. The process for preparing free-flowing, solid, high active alkyl ether sulfates according to claim 6, wherein, the alkali metal carbonate is sodium carbonate.

8. The process for preparing free-flowing, solid, high active alkyl ether sulfates according to claim 3, wherein, the structurant is sugar or a derivative thereof.

9. The process for preparing free-flowing, solid, high active alkyl ether sulfates according to claim 3, wherein, the coating material is silica or a silicate.

10. Free-flowing, solid, high active alkyl ether sulfate compositions comprising a. 50% to 90% by weight of alkyl ether sulfate;

b. 0.5% to 5% by weight of carbonate;

c. 5% to 50% by weight of a mixture of amorphous and crystalline zeolites in a ratio of 80:20 to 20:80;

d. 0.5% to 3% by weight of structurant;

e. 1% to 10% by weight of coating material.

11. The free-flowing, solid, high active alkyl ether sulfate compositions according to claim 10, wherein the carbonate and zeolite are in a ratio of 1:10 to 1:50.

12. The free-flowing, solid, high active alkyl ether sulfate compositions according to claim 10, wherein the carbonate is an alkaline earth metal carbonate or an alkali metal carbonate or their bicarbonates or mixtures thereof.

13. The free-flowing, solid, high active alkyl ether sulfate compositions according to claim 12, wherein the alkali metal carbonate is sodium carbonate.

14. The free-flowing, solid, high active alkyl ether sulfates according to claim 10, wherein the moisture content is 0-5% by weight.

15. The free-flowing, solid, high active alkyl ether sulfates according to claim 10, wherein the structurant is sugar or a derivative thereof.

16. The free-flowing, solid, high active alkyl ether sulfates according to claim 10, wherein the coating material is silica or a silicate.

17. The free-flowing, solid, high active alkyl ether sulfates according to claim 10, wherein the high active alkyl ether sulfates are colored.

18. A laundry detergent composition comprising free-flowing, solid, high active alkyl ether sulfates according to claim 10.

19. A dish-washing detergent composition comprising free-flowing, solid, high active alkyl ether sulfates according to claim 10.

* * * * *